US007160026B2

(12) United States Patent
Golay

(10) Patent No.: US 7,160,026 B2
(45) Date of Patent: Jan. 9, 2007

(54) TRI-AXIAL TOURBILLON FOR A TIMEPIECE, IN PARTICULAR A WRISTWATCH

(75) Inventor: Jean-Pierre Golay, Sion (CH)

(73) Assignee: Franck Muller Watchland S.A. (CH)

( * ) Notice: Subject to any disclaimer, the term of this patent is extended or adjusted under 35 U.S.C. 154(b) by 148 days.

(21) Appl. No.: 11/074,419

(22) Filed: Mar. 8, 2005

(65) Prior Publication Data

US 2005/0201209 A1 Sep. 15, 2005

(30) Foreign Application Priority Data

Mar. 9, 2004 (CH) ..... 0394/04

(51) Int. Cl.
*G04B 17/28* (2006.01)
*G04B 33/08* (2006.01)

(52) U.S. Cl. ..... 368/127; 368/142

(58) Field of Classification Search ..... 368/124–128, 368/142, 144, 76, 77, 220
See application file for complete search history.

(56) References Cited

U.S. PATENT DOCUMENTS 5,608,694 A * 3/1997 Grimm et al. ..... 368/127
5,838,641 A * 11/1998 Tohkoku et al. ..... 368/127
6,402,368 B1 * 6/2002 Grimm et al. ..... 368/127
6,846,104 B1 * 1/2005 Geyer ..... 368/127
6,863,434 B1 * 3/2005 Mojon ..... 368/127
6,890,094 B1 * 5/2005 Dias ..... 368/127

FOREIGN PATENT DOCUMENTS

EP 1465024 A1 * 10/2004 ..... 368/127

* cited by examiner

*Primary Examiner*—Vit Miska
*Assistant Examiner*—Jeanne-Marguerite Goodwin
(74) *Attorney, Agent, or Firm*—Ostrolenk, Faber, Gerb & Soffen, LLP

(57) ABSTRACT

The tri-axial tourbillon comprises a cage (A) containing the balance (1), the escape wheel (2) and the escape pinion (3) rotating around an axis (A1) and mounted in a second cage (B) rotating around an axis (A2), the cage (B) in turn being mounted rotably in a third cage (C) rotating around an axis (A3) that is fixed relative to the timepiece, the three axes (A1, A2, A3) being perpendicular to each other.

8 Claims, 2 Drawing Sheets

TRI-AXIAL TOURBILLON FOR A TIMEPIECE, IN PARTICULAR A WRISTWATCH

Figure 1:
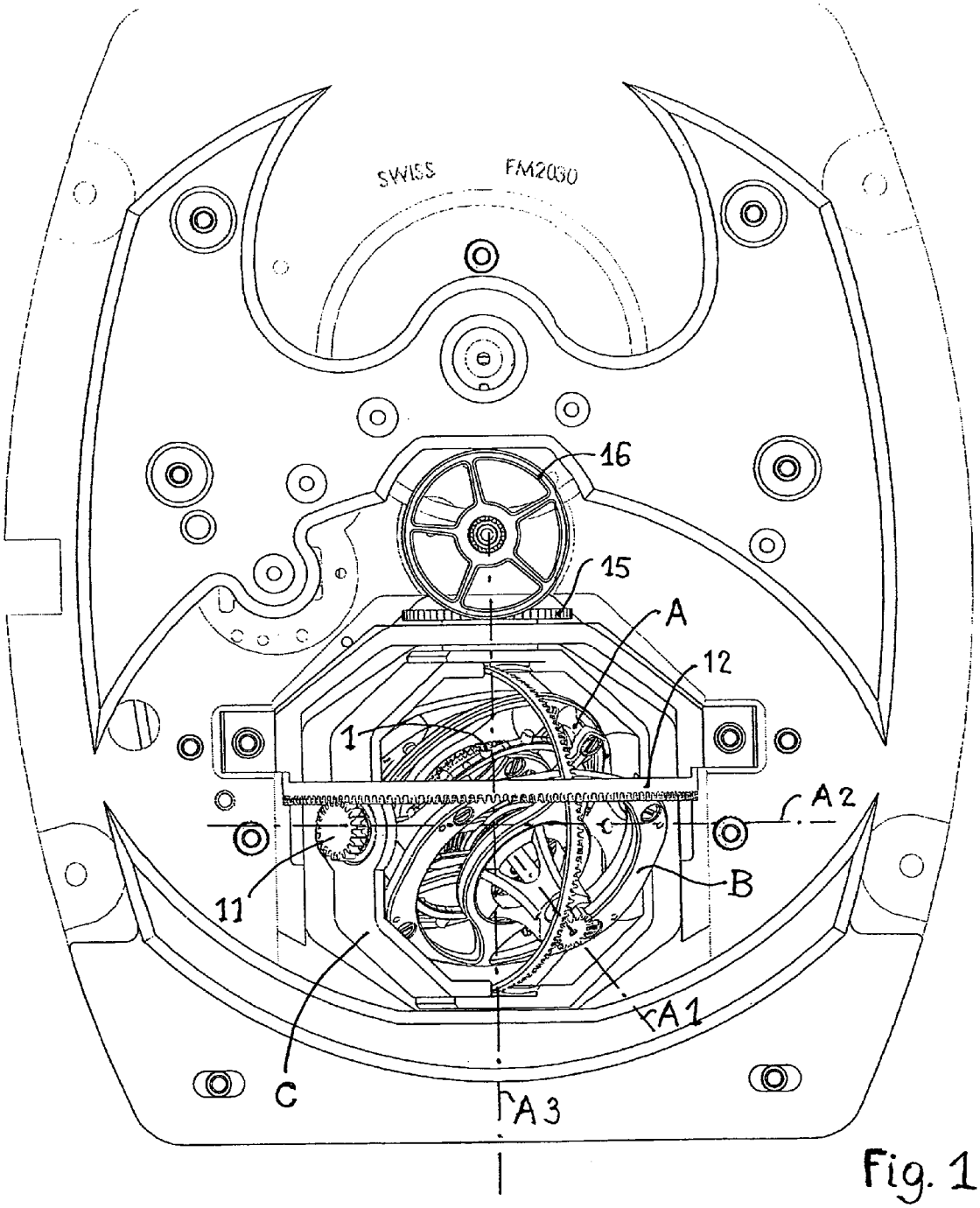

The object of this invention is a tri-axial tourbillon for a timepiece, in particular a wristwatch.

In operation, the rate of a timepiece is not the same when it is in a vertical position or a horizontal position. A pocket watch may for example be adjusted quite easily as most of the time it is placed in a vertical position. The adjustment made in this position can be carried out easily, and it will be possible to keep to a variation of 0 to 1 second per day. However, if the pocket watch is placed in a horizontal position, i.e. placed on a table for example, it will be noted that the rate variation will then be approximately 10 seconds per day.

A wristwatch is generally worn in a horizontal position. However, depending on the wearer, the average position of the watch can vary considerably. As a result, if it is adjusted in a horizontal position, it may, in some cases, show a relatively high rate variation.

To remedy this disadvantage, the owner has proposed a bi-axial tourbillon described in Swiss patent no. . . . (application no. 590/2003) as well as a tri-axial tourbillon described in Swiss patent no. . . . (application no. 1282/2001). The main problem posed by these bi-axial or tri-axial tourbillons amounts to the production of mechanisms that are as small as possible, so that they can be housed in a wristwatch that is still relatively thin. It is therefore necessary to find mechanisms that meet this criterion.

The tri-axial tourbillon, particularly for a wristwatch, according to the invention, is characterised in that the tourbillon comprises a cage containing the balance and the escapement rotating on an axis, the cage being mounted in a second cage so that it can rotate around another axis, the second cage being in turn mounted rotatably in a third cage rotating around an axis that is fixed relative to the timepiece, the three axes being perpendicular to each other.

According to a preferred embodiment, the tri-axial tourbillon is driven by a power wheel mounted on the bottom plate of the timepiece, which drives a pinion securely attached to the third cage, and causes the said cage to rotate around its axis, thus rotating a pinion meshing with a crown wheel fixed to the bottom plate of the timepiece, which rotatably drives the cage around its axis, the second cage rotating the first cage around its axis by means of a crown wheel and the second pinion, which is securely attached to the third cage, and thus transmitting the energy from the power wheel to the assembly formed by the escape pinion, the escape wheel and the balance placed in the first cage.

The drawing shows, as an example, an embodiment of a tri-axial tourbillon for a timepiece according to the invention.

Figure 2:
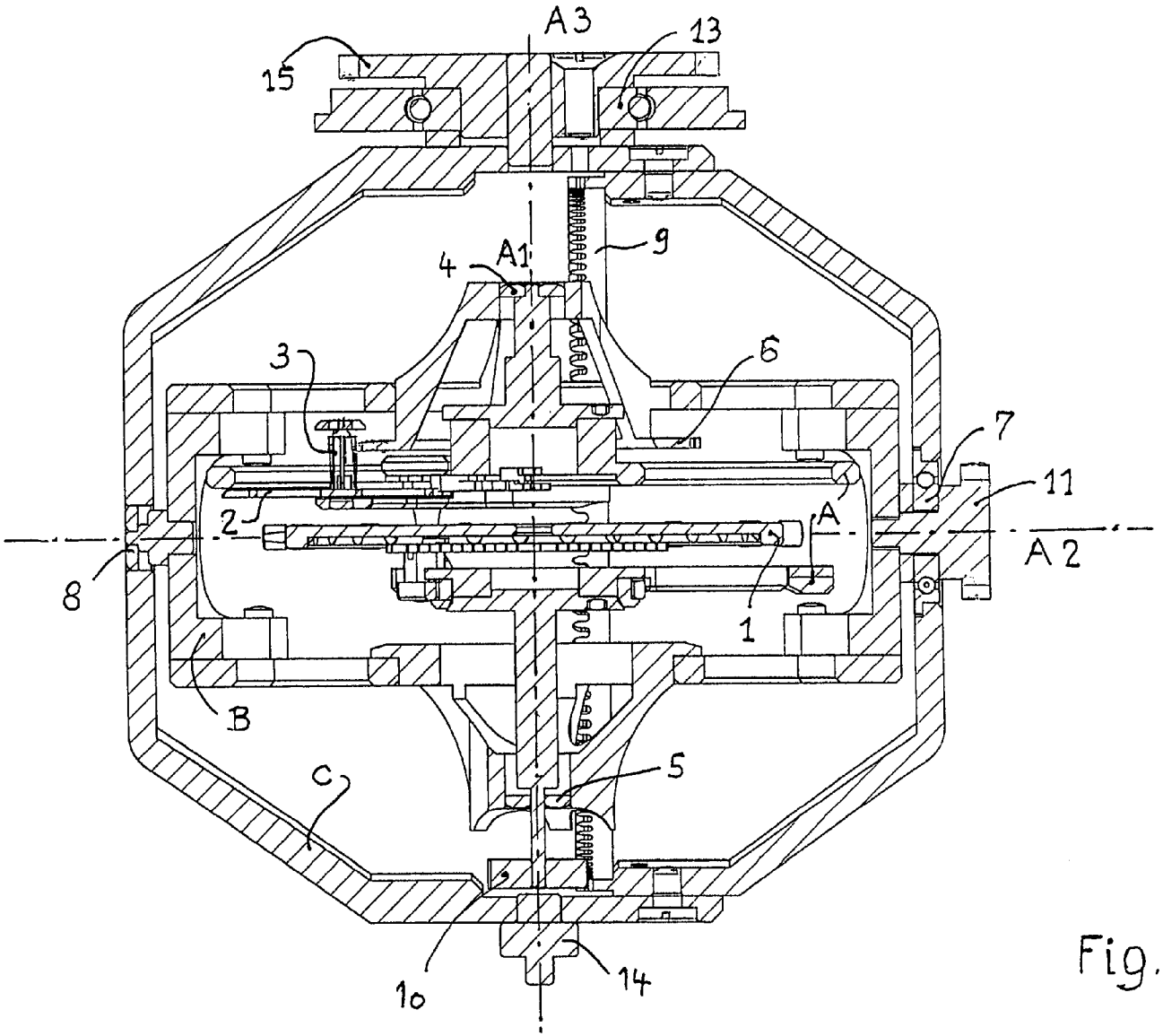

In the drawing:

FIG. 1 is a perspective view of a tri-axial tourbillon mounted on the bottom plate of a timepiece, and FIG. 2 is a cross-section of the tourbillon along the axis of the balance in which, for greater clarity, the bottom plate and the fixed hour wheel are not shown.

The tri-axial tourbillon shown in FIGS. 1 and 2 has been developed for a wristwatch. This use is not however limitative, and the tourbillon can be used to equip pocket watches or small clocks.

The tri-axial tourbillon comprises a tourbillon cage A containing the balance 1, the escape wheel 2 and the escape pinion 3. This cage is placed inside a second cage B in which it rotates on the two bearings 4, 5, and which holds the fixed second wheel 6 with which the escape pinion 3 meshes. The cage B itself rotates in the third cage C on two bearings 7, 8. The third cage C is fitted with a toothed crown wheel 9 with which the second pinion 10, securely attached to the cage A, meshes.

The cage C holds at one of its rotating ends a pinion 11 that meshes with a fixed hour wheel 12 housed in the bottom plate of the movement. The cage C rotates on two bearings 13, 14 securely attached to the movement, and holds on one of its pivot points a pinion 15 driven by the centre wheel 16 of the movement (FIG. 1).

The bearings 4 and 5 of the cage A, and the bearings 8 and 14 of the cages B and C respectively are, as shown in the drawing, jewel bearings. The bearings 7 and 13 of the cages B and C respectively are ball bearings.

The cage A comprising the balance 1, the escape wheel 2 and the escape pinion 3, rotates around the axis A1, whilst the cages B and C rotate around their axes A2 and A3, the three axes A1, A2 and A3 being perpendicular to each other.

The operation of the tourbillon described in FIGS. 1 and 2 can easily be explained as follows:

Under the effect of the motive force of the wheel 16 (FIG. 1), the pinion 15 imparts movement to the cage C, which rotates around its axis A3. By means of the pinion 11 and the fixed crown wheel 12, the cage B will in turn rotate around its axis A2, and impart movement to the cage A around its axis A1 by means of its crown wheel 9 and the second pinion 10, which is securely attached to the cage A, and transmit the energy necessary for the operation of the escapement and the balance 1.

It will be apparent to a person skilled in the art that the construction of the tourbillon described with reference to FIGS. 1 and 2 is characterised by a coupling of the said tourbillon along three axes, which allows for a considerable reduction in the rate variations of the timepiece due to its position, and for the timepiece to be made completely independent of its positioning relative to the earth's gravity. The accuracy of the watch is thus considerably improved. Moreover, if the tri-axial tourbillon that has just been described is placed so that it can be seen through a window made in the dial, the aesthetic appearance of the timepiece is partially pleasing.

Finally, the rotation period of each of the cages can be displayed on the dial of the timepiece by means of conventional hands or a retrograde display device.

The invention claimed is:

1. Tri-axial tourbillon for a timepiece, particularly a wristwatch, characterised in that the tourbillon comprises a first cage (A) containing the balance (1) and the escapement (2 and 3), rotating around an axis (A1), a second cage (B) being in turn mounted rotating around its axis (A2) in a third cage (C) rotating around an axis (A3) that is fixed relative to the timepiece, the three axes (A1, A2 and A3) being perpendicular to each other.

2. Tri-axial tourbillon according to claim 1, characterised in that a power wheel (16) mounted on the bottom plate of the timepiece drives a pinion (15) securely attached to the third cage (C) and causes the said third cage (C) to rotate around its axis (A3) thus rotating a pinion (11) meshing with a crown wheel (12) fixed to the bottom plate of the timepiece, which rotatably drives the second cage (B) around its axis (A2), the second cage (B) rotating the first cage (A) around its axis (A1) by means of a crown wheel (9) and the second pinion (10) securely attached to the cage (A), and thus transmitting the energy from the power wheel (16) to the assembly formed by the escape pinion (3), the escape wheel (2) and the balance (1) placed in the cage (A).

3. Tri-axial tourbillon according to claim 2, characterised in that the cages (A, B, C) rotate around the axes (A1, A2, A3) on ball bearings (7, 13) or jewel bearings (4, 5 and 8, 14).

4. Tourbillon according to claim 1, characterised in that the third cage (C) is driven rotatably around its axis (A3) by a pinion (15) securely attached to the cage, and in contact with a power wheel (16) located on the bottom plate of the timepiece.

5. Tourbillon according to claim 4, characterised in that the third cage (C) is in the form of a cradle rotating around its axis (A3), the second cage (B) being mounted rotatably on bearings placed on the two lateral arms of the cradle.

6. Tourbillon according to claim 4, characterised in that the second cage (B) is in the form of two annular parts connected by lateral distance pieces holding the rotation bearings of the cage, inside which the first cage (A) is mounted.

7. Tourbillon according to claim 1, characterised in that the second cage (B) is placed inside the cage (C) and driven around its axis (A2) by a pinion (11) meshing with a toothed crown wheel (12) securely attached to the bottom plate.

8. Tourbillon according to claim 1, characterised in that the first cage (A) is placed inside the second cage (B) and driven around its axis (A1) by a second pinion (10) of the timepiece meshing with a toothed crown wheel (9) securely attached to the third cage (C).

* * * * *